US006883553B2

(12) United States Patent
Bassi et al.

(10) Patent No.: US 6,883,553 B2
(45) Date of Patent: Apr. 26, 2005

(54) HEDDLE AND PROCESS FOR MANUFACTURING SAME, SHED-FORMING DEVICE AND WEAVING LOOM INCORPORATING SUCH A HEDDLE

(75) Inventors: Dario Bassi, Chaponnay (FR); Damien Bouchet, Chaponnay (FR); Guillaume Boutte, Aveize (FR)

(73) Assignee: Staubli Lyon, Chassieu (FR)

( * ) Notice: Subject to any disclaimer, the term of this patent is extended or adjusted under 35 U.S.C. 154(b) by 142 days.

(21) Appl. No.: 10/358,263

(22) Filed: Feb. 5, 2003

(65) Prior Publication Data

US 2003/0145898 A1 Aug. 7, 2003

(30) Foreign Application Priority Data

Feb. 7, 2002 (FR) ..... 02 01509

(51) Int. Cl.[7] ..... D03C 9/00
(52) U.S. Cl. ..... 139/93
(58) Field of Search ..... 139/91, 93; 29/4.6; 72/366.2

(56) References Cited

U.S. PATENT DOCUMENTS

| | | | | |
|---|---|---|---|---|
| 2,690,771 A | | 10/1954 | Consoletti | |
| 5,152,325 A | * | 10/1992 | Koch | 139/91 |
| 5,261,464 A | | 11/1993 | Lorenzo et al. | |
| 5,348,055 A | * | 9/1994 | Kramer | 139/93 |

FOREIGN PATENT DOCUMENTS

| | | |
|---|---|---|
| EP | 0536092 | 4/1993 |
| WO | 0055407 | 9/2000 |

* cited by examiner

*Primary Examiner*—John J. Calvert
*Assistant Examiner*—Andrew W. Sutton
(74) *Attorney, Agent, or Firm*—Dowell & Dowell, P.C.

(57) ABSTRACT

This invention relates to a heddle formed in a metal band or strip which comprises an eyelet for passage of a warp yarn and presents, over substantially the whole of a zone included between this eyelet and a first end by which it is connected to a drive means, a cross-section substantially in the shape of a Z, with two branches substantially parallel to each other.

10 Claims, 3 Drawing Sheets

HEDDLE AND PROCESS FOR MANUFACTURING SAME, SHED-FORMING DEVICE AND WEAVING LOOM INCORPORATING SUCH A HEDDLE

BACKGROUND OF THE INVENTION

FIELD OF THE INVENTION

The present invention relates to a heddle for a weaving loom and to a process for manufacturing such a heddle. The invention also relates to a shed-forming device and to a weaving loom incorporating such a heddle.

BRIEF DESCRIPTION OF THE RELATED ART

The heddles of weaving looms are generally formed by metallic filiform elements in each of which is formed an eyelet for passage of a warp yarn. EP-A-0947 620 discloses a heddle in which an eyelet is added in a notch made in a filiform element.

In order to limit its dimensions in a direction parallel to the weft yarns, a heddle manufactured from a band or strip of metal should be oriented with its width parallel to the direction of passage of the warp yarns, which would not be compatible with the simple formation of an eyelet in such a heddle. In effect, such an eyelet must have its width substantially perpendicular to the direction of passage of the warp yarns. It is known, for example from FR-A-2 711 679, locally to deform a heddle formed in a metal band or strip so that the branches of an eyelet of such a heddle are set in order to give the eyelet a sufficient width. Now, due to the vertical oscillatory movement of the heddles, the eyelets, which present a greater width than the upper and lower branches of the heddles, tend to push the adjacent yarns upon each passage, hence a risk of vibrations of the harness cords of a loom equipped with this type of heddles or of damage of the warp yarns. In addition, such a heddle is relatively complex to manufacture and its cost may prove prohibitive in the case of a loom comprising a large number of warp yarns. Finally, it is not certain that such a heddle presents sufficient flexural rigidity in order correctly to withstand the efforts to which it is subjected during weaving, particularly in the case of it having to be controlled positively as in a shed-forming assembly known from FR-A-2 811 687.

It is a particular object of the present invention to overcome these drawbacks by proposing a novel heddle whose shape makes it possible to avoid the vibrations in the harness, while it presents excellent mechanical properties.

SUMMARY OF THE INVENTION

To that end, the invention relates to a heddle for a weaving loom, this heddle being formed in a metal band or strip and comprising an eyelet for passage of a warp yarn. This heddle has, over substantially the whole of a zone or portion of the body of the heddle included between this eyelet and a first end of the heddle by which it is fastened to a drive means, a substantially Z-shaped cross-section, taken generally perpendicular to an elongated axis of the heddle, with two branches or elongated flanges which are substantially parallel but offset to each other.

Thanks to the invention, a warp yarn passing through the heddle may be guided in its direction of advance on the two branches of the heddle, but also on the corresponding branches of the adjacent heddles, over the whole zone included between the eyelet and the first end of the heddle. A high density of heddles according to the invention may therefore be implanted on a weaving loom, the warp yarns not being injured upon contact of the heddles or struck thereby since the branches that they form serve as means for guiding over the whole height of the above-defined zone. In addition, the S or Z-shaped cross-section gives the heddle of the invention a good rigidity.

According to advantageous but non-obligatory aspects of the invention, the heddle incorporates one or more of the following characteristics:

- It presents a substantially constant S- or Z-shaped cross-section over the whole of its length defined between its two opposite ends. In this way, the heddle constitutes an efficient means for guiding the adjacent yarns whatever its position in height on a loom. In addition, it may be manufactured relatively simply.
- The heddle is provided with openings for lightening purposes in a median zone of the heddle essentially defined between the branches. These openings make it possible to save matter and to reduce the inertia of the heddle. They may be provided to be disposed between the eyelet and a free end of the heddle, in which case they do not risk having a mechanical influence on the transmission of efforts between a drive member and the eyelet. However, these openings may be provided to be disposed on either side of the eyelet, between the eyelet and the opposite ends of the heddle, in which case the effect of reduction of the inertia and of saving of matter is even greater.

The invention also relates to a process for manufacturing a heddle as described hereinabove and, more specifically, to a process which comprises a step consisting in rolling or drawing a band or strip of metal, forming two parallel bends defining two branches extending on either side of a median zone of the heddle. Such a process is particularly economical and makes it possible to envisage mass-production of heddles.

The invention also relates to a shed-forming device for a weaving loom which comprises at least one heddle as described hereinbefore.

This device advantageously also comprises a means for guiding the heddle in translation, this means being provided with at least one opening of substantially Z-shaped cross-section, with two branches substantially parallel to each other.

According to another advantageous aspect, one end of each heddle is engaged in a sleeve in which is also engaged by the opposite end, an effort-transmission element in the form of a semi-rigid ring, the sleeve being connected with the heddle and the afore-mentioned element, this allowing a positive transmisison of efforts between this element and this heddle. The sleeve and this element may be connected by crimping, reversible or definitive adhesion, clipping, cooperation of shapes, soldering, welding and/or elastic wedging.

Finally, the invention relates to a weaving loom which comprises a shed-forming device as described hereinabove. Such a loom is more economical and more reliable than those of the state of the art, in particular because it has less tendency to vibrate.

BRIEF DESCRIPTION OF THE DRAWINGS

The invention will be more readily understood on reading the following description of an embodiment of a heddle, a shed-forming device and a weaving loom, given solely by way of example and made with reference to the accompanying drawings, in which.

DESCRIPTION OF PREFERRED EMBODIMENT

Figure 1:
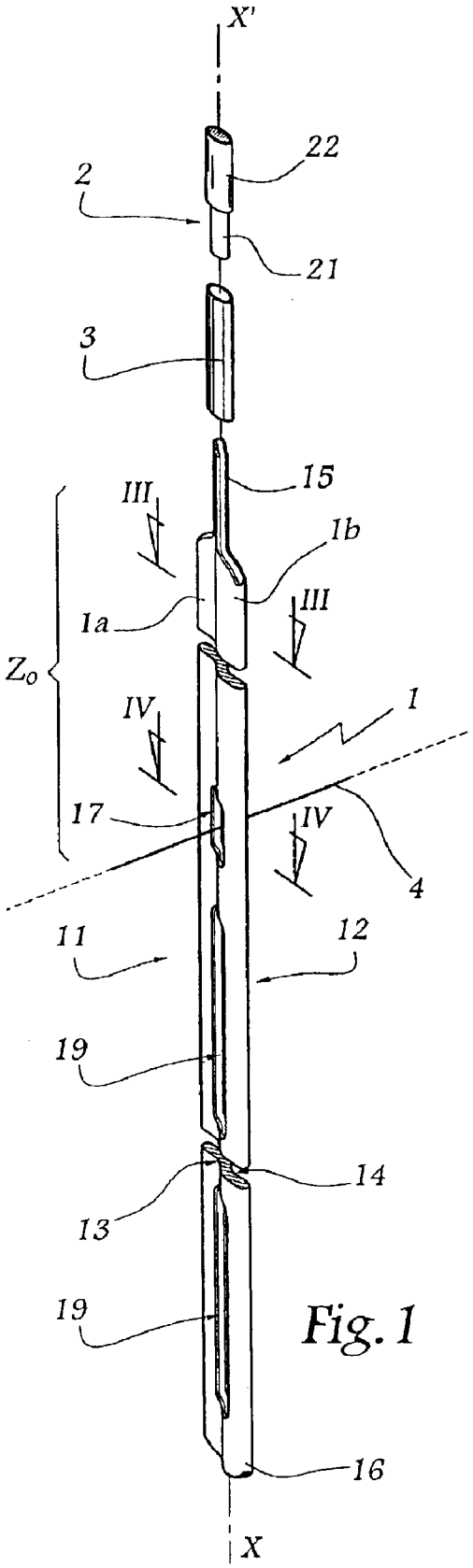
FIG. 1 is a view in perspective, with interruptions, of a heddle according to the invention.
Figure 2:
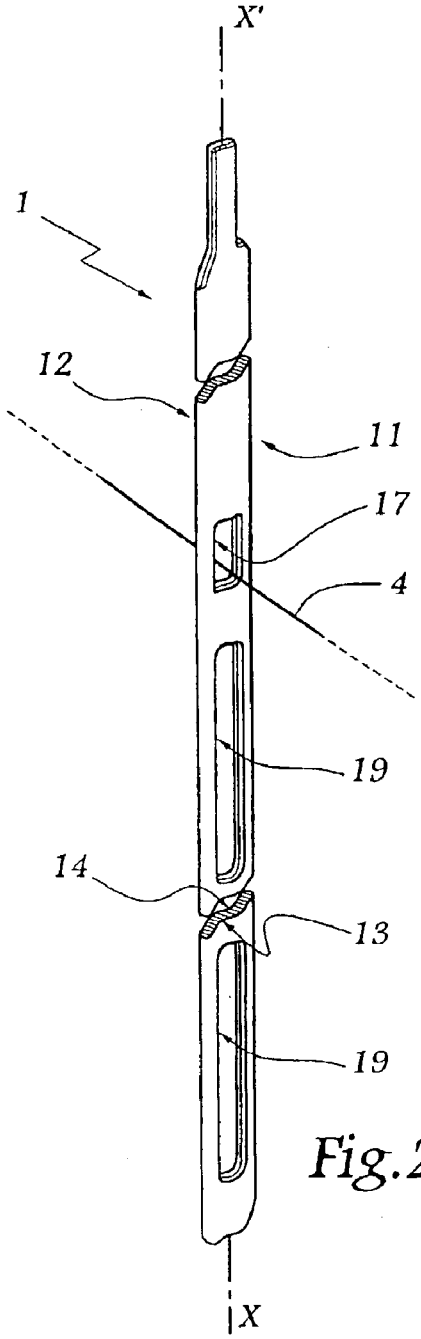
FIG. 2 is a view in perspective, with interruptions and taken from another angle, of the heddle of FIG. 1.

Referring now to the drawings, the heddle 1 shown in FIGS. 1 to 4 is formed in a steel band or strip which defines an elongated body thereof, by rolling, by means of two rollers which crush and deform this band so as to constitute on the lateral faces 11 and 12 of the heddle 1, bends or elongated flanges 13 and 14 which are parallel to each other and parallel to a central longitudinal axis X–X' of the heddle 1.

The heddle 1 includes an end 15 by which it may be connected to a semi-rigid ring 2, for example made of carbon, which functions as a drive connection as explained herein below. The heddle 1 and the ring 2 are connected by a sleeve 3 in which are inserted the end 15 and the lower end 21 of the ring 2, each of these ends 15 and 21 penetrating in the sleeve 3 by one side thereof. The ends 15 and 21 may be adhered, definitively or reversibly, inside the sleeve 3. The ends 15 and 21 may also be crimped, elastically wedged, clipped or immobilized by cooperation of shapes inside the sleeve 3. In a variant, the assembly of the sleeve and of the end 15 may be effected by soldering or welding. The immobilization between the sleeve 3 and at least one of the elements 1 and 2 is advantageously reversible, this making it possible to dismantle the connection thus produced, particularly for maintenance operations. The heddle includes an end 16 opposite end 15.

An eyelet 17 is formed in the heddle 1 for the passage of a warp yarn 4. As is more particularly visible in FIG. 3, the heddle 1 has, in a plane perpendicular to axis X–X', an S like cross-section having a substantially flattened Z shape, with two branches 1*a* and 1*b* extending in directions Ya–Y'a and Yb–Y'b perpendicular to axis X–X' and parallel to each other. These branches 1*a* and 1*b* are connected by a median zone 1*c* which extends substantially in a direction D perpendicular to axis X–X' and forming an angle $\alpha$ of the order of 45° with respect to directions Y*a*–Y'*a* and Y*b*–Y'*b*.

Figure 3:
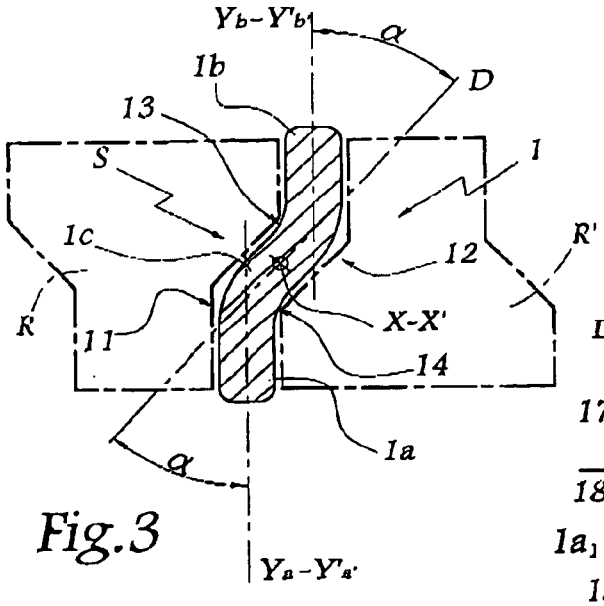
FIG. 3 is a section along line III—III in FIG. 1, on a larger scale.

The heddle 1 presents the S-section shown in FIG. 3 over substantially the whole height of a zone $Z_0$ or body Portion of the heddle included between the end 15 and the eyelet 17, such that the branches 1*a* and 1*b* define the elongated flanges 13 and 14.

Figure 4:
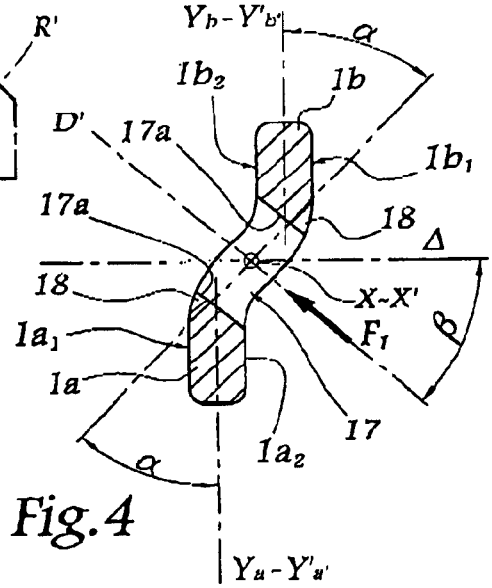
FIG. 4 is a section, on the same scale as that of FIG. 3, along line IV—IV in FIG. 1.

At the level of the eyelet 17 and as shown in FIG. 4, the heddle 1 presents the same S-section substantially shaped as a flattened Z, as at the level of the plane of section of FIG. 3, an opening being made at the level of zone 1*c* to constitute the eyelet 17.

In practice, the opening 17 is formed by stamping in a direction D' substantially perpendicular to the direction D and making, with a straight line $\Delta$ perpendicular to the lateral faces $1a_1$, $1a_2$, $1b_1$, and $1b_2$ of branches 1*a* and 1*b*, an angle $\beta$ substantially equal to the angle $\alpha$.

The fact that the eyelet 17 is made by stamping in the direction D', as represented by arrow $F_1$ in FIG. 4, allows its edges 17*a* to be substantially parallel to this direction and heels 18 to be formed on either side of the opening 17 at the foot of the branches 1*a* and 1*b*, this conserving for the heddle thus formed a good rigidity in torsion about axis X–X', despite the presence of the eyelet 17.

Openings 19 are made in the heddle 1 between the eyelet 17 and the end 16. According to a variant of the invention (not shown), corresponding openings might also be made between the eyelet 17 and the end 15. These openings 19 are made by localized punching of the median zone 1*c* and make it possible to save matter during production of the heddle 1 and to reduce its inertia, which is particularly advantageous since such a heddle is intended to undergo repeated reversals of movement for very brief periods. The holes have no influence on the geometry of the edges of the heddle 1 which remain formed by the branches 1*a* and 1*b*.

At the level of an opening 19, the S cross-section of the heddle 1 has substantially the same geometry as that shown in FIG. 4. The S-section of the heddle 12 conserves the same geometry between the ends 15 and 16, subject to openings 17 or 19 being provided at certain places.

Figure 5:
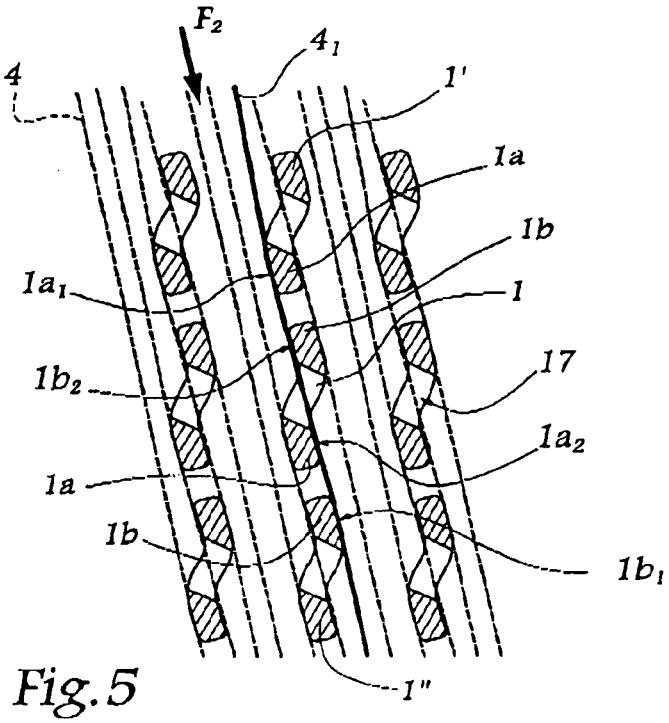
FIG. 5 schematically shows, in cross-section, a shed-forming device incorporating heddles such as the one shown in FIGS. 1 to 4.

As is more particularly visible in FIG. 5, when a plurality of heddles according to the invention are juxtaposed in a shed-forming device, the different warp yarns 4 may follow substantially parallel paths in a direction represented by arrow $F_2$, each traversing the eyelet 17 of a heddle 1 and running along the branches 1*a* and 1*b* of this heddle, on either side of the eyelet 17, and of the adjacent heddles.

More particularly, if reference is made to the heddle 1 shown at the centre of FIG. 5, the associated warp yarn $4_1$ may run along the outer surface $1a_1$, of the branch 1*a* of the heddle 1' located at the centre of the upper part of FIG. 5. In that case, the yarn $4_1$ runs along the inner surface $1b_2$ of the branch 1*b* of the heddle 1 in question then the inner surface $1a_2$ of the branch 1*a* of this heddle. The yarn $4_1$ then runs along the outer surface $1b_1$ of the branch 1*b* of the heddle 1" shown at the centre of the lower part of FIG. 5. It will thus be understood that the different heddles define with one another and thanks to their branches 1*a* and 1*b*, paths that the warp yarns 4 can follow. The branches 1*a* and 1*b* of the heddles 1, 1' and 1" therefore serve to guide the warp yarns such as yarn $4_1$.

As the S cross-section of the heddle 1 is substantially constant between the eyelet 17 and the end 15, the function of guiding mentioned with reference to FIG. 5 is conserved independently of the position in height of the heddles 1 of a shed-forming device. In other terms, the fact that a heddle is more or less lifted by the harness has no influence on its capacity to guide the warp yarns traversing the eyelets of the adjacent heddles. The warp yarns are thus subjected to substantially constant efforts, independently of the height of the heddles, this limiting the vibrations in the harness of a loom equipped with such heddles.

Figures 6, 7:
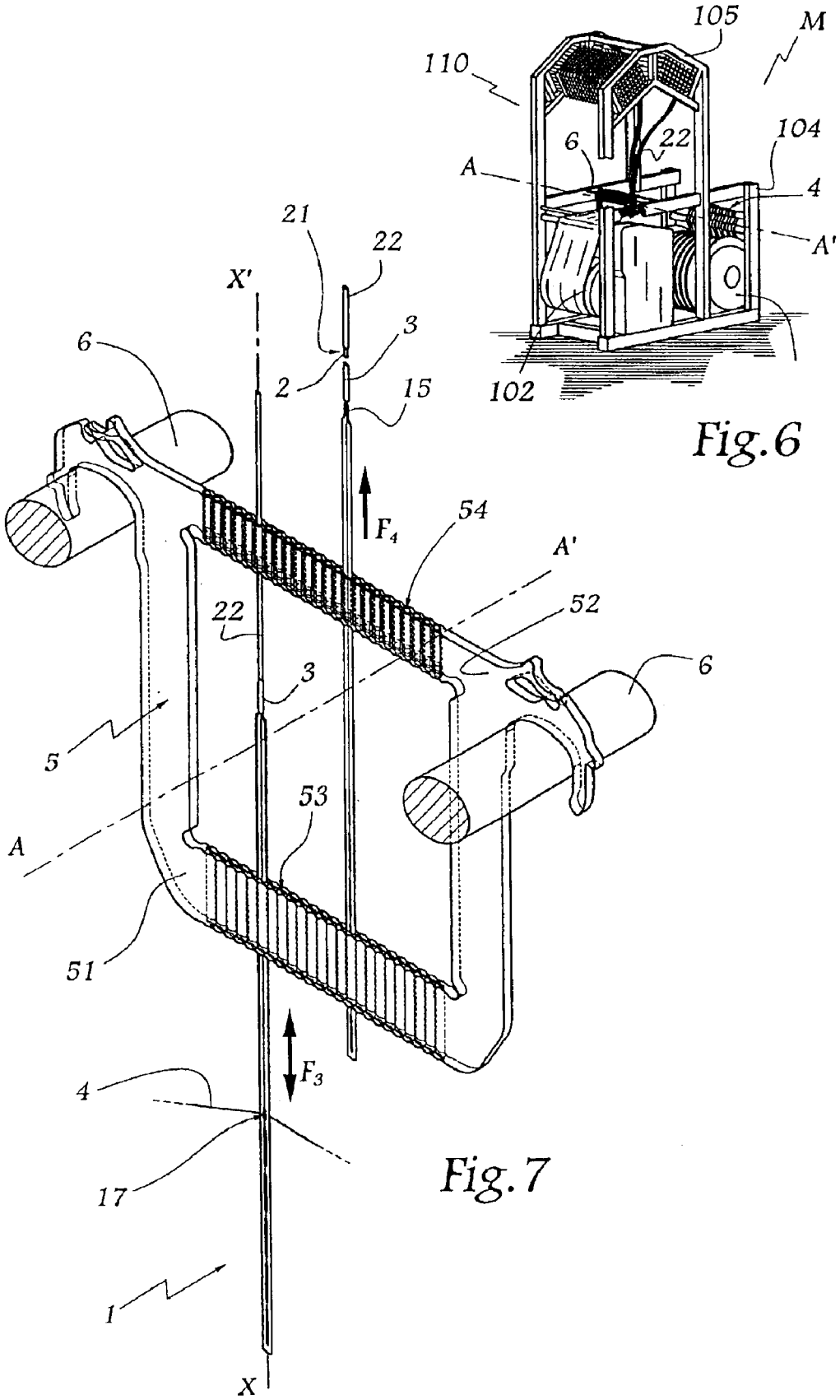
FIG. 6 is a view in perspective of a weaving loom incorporating a device according to FIG. 6, and FIG. 7 schematically shows heddles according to FIGS. 1 to 4 in place in the shed-forming device of the loom of FIG. 6.

Such a loom M is schematically shown in FIG. 6 and comprises a beam 101 and a reel 102 between which the warp yarns 4 circulate. A–A' denotes the direction of the picks on the loom M, i.e. the direction of the weft yarns.

The loom M also comprises a frame 104 supporting the elements 101 and 102 and a system (not shown) for passage of the picks.

The chassis 104 extends by a superstructure 105 arranged above the principal part of the loom M and supporting a device 110 for controlling an assembly of rings 2 which are disposed in sheaths 22 and which constitute a harness for the loom M. In order to render the drawing clearer, only a part of the sheaths 22 has been shown in FIG. 6.

As is more particularly visible in FIG. 7 where only two heddles have been shown in order to render the drawing clearer, the different heddles 1 are guided in translation along their respective longitudinal axes X–X' inside members 5 made of plastics material resting on rails 6 extending on the loom M in directions substantially parallel to direction A–A'.

The members 5 define two cross-pieces 51 and 52 extending one above the other and perpendicularly to the direction A–A'. The cross-piece 51 is provided with openings 53 whose section is similar to the S-section of the heddle 1 that they receive. In the same way, the cross-piece 52 is provided with openings 54 for receiving the lower end of a sheath 22 and for passage of a ring 2.

In this way, the openings 53 and 54 make it possible to control and to guide the heddle 1 shown in the lowermost position in FIG. 7 in its vertical oscillatory movement, in the direction of its axis X–X', this movement being represented by the double arrow $F_3$.

When it is necessary to proceed with the exchange of a heddle, for example for a maintenance operation, the latter can be extracted from the member 5, as represented by arrow $F_4$ in FIG. 7, by passing through the corresponding orifice 54. The assembly made at the level of the sleeve 3 between the heddle 1 and the ring 2 is then dismounted before connection of the ring with a fresh heddle and positioning of the latter in the member 5 through the corresponding orifices 54 and 53.

The heddle according to the invention may be controlled positively by the ring 2, i.e. it is not necessary to provide an elastic return in the lower part of the loom.

According to a variant of the invention (not shown), a heddle 1 may be controlled positively by the underneath of the lap of warp yarns 4, in which case its end 15 is located below this lap while its end 16 projects above the latter. This variant makes it possible to dispense with the superstructure 105 shown in FIG. 6 by integrating the device 110 in the chassis 104.

The invention is applicable in particular to any heddle coupled to a drive member by one end, whether it be question of an individual control of Jacquard type, as known from FR-A-2 811 687, or of a common control of dobby type, or to a heddle controlled by its two ends, for Jacquard loom or dobby.

Within the meaning of the present invention, a Z-section also covers an S-section. In effect, the shape of the cross-section is an S or a Z depending on the direction of observation of this section.

What is claimed is:

1. Heddle for a weaving loom, the heddle comprising; an elongated body having an eyelet therethrough for passage of a warp yarn and a body portion which extends between said eyelet and a first end of said body by way of which the body is connected to a drive means, said body portion having a substantially Z-shaped cross-section taken perpendicularly with respect to an elongated axis (X–X') of said elongated body along at least a substantial length thereof so as to define two elongated flanges which are offset and substantially parallel to each other.

2. Heddle according to claim 1, wherein said body has a substantially constant Z-shaped cross-section over it's a length thereof defined between said first end and a second opposite end.

3. Heddle according to claim 1, wherein said body includes at least one hole therein spaced from said eyelet for reducing a weight of the heddle.

4. Heddle according to claim 3, including a plurality of holes arranged between said eyelet and said second opposite end end of said body of the heddle.

5. Heddle according to claim 3, including a plurality of holes arranged on either side of said eyelet, between said first end and said second opposite end of said body of the heddle.

6. Process for manufacturing a heddle for a weaving loom, wherein the heddle is formed of a metal band or strip comprising an eyelet for passage of a warp yarn and which eyelet is spaced from a first end by way of which the heddle is fastened to a drive means, wherein said process comprises a step consisting in rolling or drawing the metal band or strip to form two generally parallel elongated flanges extending on either side of a median elongated axis (X–X') of the heddle and such that a cross-section through the heddle and perpendicular to said longitudinal axis is generally Z-shaped.

7. Device for forming a shed in a weaving loom, comprising a shed-forming device including at least one heddle according to claim 1.

8. Device according to claim 7, wherein the shed-forming device includes a guide means for guiding said at least one heddle in translation with respect to said longitudinal axis (X–X'), said guide means being provided with at least one opening of substantially Z-shaped cross-section, in which said at least one heddle is cooperatively received.

9. Device according to claim 7, wherein said first end of said body of the at least one heddle is engaged in a sleeve in which there is also engaged, an element for transmission of force to the at least one heddle, the at least one sleeve being connected with said heddle and said element.

10. Weaving loom comprising: a shed-forming devices, said shed-forming device including at least one heddle, said at least one heddle including an elongated body having an eyelet therethrough for passage of a warp yarn and a body portion which extends between said eyelet and a first end of said body by way of which the body is connected to a drive means, said body portion having a substantially Z-shaped cross-section, taken perpendicularly with respect to an elongated axis (X–X') of said elongated body, along at least a substantial length thereof so as to define two elongated flanges which are offset and substantially parallel to each other.

* * * * *